US006882115B2

(12) United States Patent
Song

(10) Patent No.: US 6,882,115 B2
(45) Date of Patent: Apr. 19, 2005

(54) METHOD AND APPARATUS OF PROCESSING VIDEO SIGNAL IN PLASMA DISPLAY PANEL

(75) Inventor: Byung Soo Song, Koyang-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/612,880

(22) Filed: Jul. 7, 2003

(65) Prior Publication Data

US 2005/0007028 A1 Jan. 13, 2005

(51) Int. Cl.[7] ..... G09G 3/10
(52) U.S. Cl. ..... 315/169.4; 345/207; 345/690
(58) Field of Search ..... 315/167, 169.1, 315/169.4; 345/60, 76–78, 63, 204, 207, 690

(56) References Cited

U.S. PATENT DOCUMENTS 6,351,253 B1 * 2/2002 Kasahara et al. ..... 345/63
6,353,424 B1 * 3/2002 Kasahara et al. ..... 345/63
6,384,803 B1 * 5/2002 Kasahara et al. ..... 345/63
6,388,645 B1 * 5/2002 Kasahara et al. ..... 345/63
6,400,346 B1 * 6/2002 Kasahara et al. ..... 345/63
6,414,657 B1 * 7/2002 Kasahara et al. ..... 345/63
6,690,388 B1 * 2/2004 Kasahara et al. ..... 345/690
2002/0005857 A1 * 1/2002 Kasahara et al. ..... 345/611
2002/0175922 A1 * 11/2002 Koo et al. ..... 345/589
2003/0080927 A1 * 5/2003 Sim et al. ..... 345/60
2003/0169217 A1 * 9/2003 Kang et al. ..... 345/63

* cited by examiner

*Primary Examiner*—Thuy Vinh Tran
(74) *Attorney, Agent, or Firm*—Fleshner & Kim, LLP

(57) ABSTRACT

A method and apparatus for processing a video signal in a plasma display panel wherein pseudo contour noise can be eliminated without any loss of gray level. In the method, pseudo contour noise of an image to be displayed on the panel is forecasted. Then, an equalizing pulse having one gray level of a first grey level higher than a gray level to be supplied and a second gray level lower than a grey level to be supplied are applied in order to eliminate said forecasted pseudo contour noise.

10 Claims, 11 Drawing Sheets

FIG. 4
RELATED ART

| | | | | | | | | | |
|---|---|---|---|---|---|---|---|---|---|
| 127 | 127 | 127 | 128 | 128 | 128 | 128 | | | |
| 0.17883 | 0 | 0 | | | | | | | |
| 0.722383 | 0 | 0 | | | | | | | |
| 2.181524 | 0 | 0 | | | | | | | |
| 5.872757 | 0 | 0 | | | | | | | |
| 14.91629 | 0 | 0 | | | | | | | |
| 27.22095 | 4.779047 | 0 | | | | | | | |
| 38.10091 | 25.8991 | 0 | | | | | | | |
| | | | | | | | | | |
| 0.82117 | 0.17883 | 0 | 0 | | | | | | |
| 1.277616 | 0.722383 | 0 | 0 | | | | | | |
| 1.818476 | 2.181524 | 0 | 0 | | | | | | |
| 2.127241 | 5.872757 | 0 | 0 | | | | | | |
| 1.083707 | 14.91629 | 0 | 0 | | | | | | |
| 0 | 27.22095 | 4.779047 | 0 | | | | | | |
| 0 | 38.10091 | 25.8991 | 0 | | | | | | |
| | | | | | | | | | |
| | 0.82117 | 0.17883 | 0 | 0 | | | | | |
| | 1.277616 | 0.722383 | 0 | 0 | | | | | |
| | 1.818476 | 2.181524 | 0 | 0 | | | | | |
| | 2.127241 | 5.872757 | 0 | 0 | | | | | |
| | 1.083707 | 14.91629 | 0 | 0 | | | | | |
| | 0 | 27.22095 | 4.779047 | 0 | | | | | |
| | 0 | 38.10091 | 25.8991 | 0 | | | | | |
| | | | | | | | | | |
| | | 0.82117 | 0.17883 | | 0 | | | | |
| | | 1.277616 | 0.722383 | 0 | 0 | | | | |
| | | 1.818476 | 2.181524 | 0 | 0 | | | | |
| | | 2.127241 | 5.872757 | 0 | 0 | | | | |
| | | 1.083707 | 14.91629 | 0 | 0 | | | | |
| | | 0 | 27.22095 | 4.779047 | 0 | | | | |
| | | 0 | 38.10091 | 25.8991 | 0 | | | | |
| | | | | | | | | | |
| | | | 0 | 20.11822 | 43.88177 | | 0 | | |
| | | | 0 | 2.2237 | 61.68813 | 0.088168 | | | |
| | | | | | | | | | |
| | | | | 0 | 20.11822 | 43.88177 | | 0 | |
| | | | | 0 | 2.2237 | 61.68813 | 0.088168 | | |
| | | | | | | | | | |
| | | | | | 0 | 20.11822 | 43.88177 | | 0 |
| | | | | | 0 | 2.2237 | 61.68813 | 0.088168 | |
| | | | | | | | | | |
| | | | | | | 0 | 20.11822 | 43.88177 | 0 |
| | | | | | | 0 | 2.2237 | 61.68813 | 0.088168 |
| | | | | | | | | | |
| | 127 | 127 | 119.8718 | 53.02007 | 127.9118 | 128 | 128 | | |
| | w0 | w1 | w2 | w3 | w4 | w5 | w6 | | |

FIG.5

RELATED ART

| | | | | | | | | | | |
|---|---|---|---|---|---|---|---|---|---|---|
| 127 | 127 | 127 | 127+63 | 128+15 | 128 | 128 | 128 | | | |
| 0.82117 | 0.17883 | 0 | 0 | | | | | | | |
| 1.277616 | 0.722383 | 0 | 0 | | | | | | | |
| 1.818476 | 2.181524 | 0 | 0 | | | | | | | |
| 2.127241 | 5.872757 | 0 | 0 | | | | | | | |
| 1.083707 | 14.91629 | 0 | 0 | | | | | | | |
| 0 | 27.22095 | 4.779047 | 0 | | | | | | | |
| 0 | 38.10091 | 25.8991 | 0 | | | | | | | |
| | 0.82117 | 0.17883 | 0 | 0 | | | | | | |
| | 1.277616 | 0.722383 | 0 | 0 | | | | | | |
| | 1.818476 | 2.181524 | 0 | 0 | | | | | | |
| | 2.127241 | 5.872757 | 0 | 0 | | | | | | |
| | 1.083707 | 14.91629 | 0 | 0 | | | | | | |
| | 0 | 27.22095 | 4.779047 | 0 | | | | | | |
| | 0 | 38.10091 | 25.8991 | 0 | | | | | | |
| | | 0.82117 | 0.17883 | 0 | 0 | | | | | |
| | | 1.277616 | 0.722383 | 0 | 0 | | | | | |
| | | 1.818476 | 2.181524 | 0 | 0 | | | | | |
| | | 2.127241 | 5.872757 | 0 | 0 | | | | | |
| | | 1.083707 | 14.91629 | 0 | 0 | | | | | |
| | | 0 | 27.22095 | 4.779047 | 0 | | | | | |
| | | 0 | 38.10091 | 25.8991 | 0 | | | | | |
| | | | 0.82117 | 0.17883 | 0 | 0 | | | | |
| | | | 1.277616 | 0.722383 | 0 | 0 | | | | |
| | | | 1.818476 | 2.181524 | 0 | 0 | | | | |
| | | | 2.127241 | 5.872757 | 0 | 0 | | | | |
| | | | 1.083707 | 14.91629 | 0 | 0 | | | | |
| | | | 0 | 27.22095 | 4.779047 | 0 | | | | |
| | | | 0 | 38.10091 | 25.8991 | 0 | | | | |
| | | | | 0.82117 | 0.17883 | 0 | 0 | | | |
| | | | | 1.277616 | 0.722383 | 0 | 0 | | | |
| | | | | 1.818476 | 2.181524 | 0 | 0 | | | |
| | | | | 2.127241 | 5.872757 | 0 | 0 | | | |
| | | | | 1.083707 | 14.91629 | 0 | 0 | | | |
| | | | | 0 | 27.22095 | 4.779047 | 0 | | | |
| | | | | 0 | 38.10091 | 25.8991 | 0 | | | |
| | | | | | 0.82117 | 0.17883 | 0 | 0 | | |
| | | | | | 1.277616 | 0.722383 | 0 | 0 | | |
| | | | | | 1.818476 | 2.181524 | 0 | 0 | | |
| | | | | | 2.127241 | 5.872757 | 0 | 0 | | |
| | | | | | 0 | 20.11822 | 43.88177 | 0 | | |
| | | | | | 0 | 2.2237 | 61.68813 | 0.088168 | | |
| | | | | | | 0 | 20.11822 | 43.88177 | 0 | |
| | | | | | | 0 | 2.2237 | 61.68813 | 0.088168 | |
| | | | | | | | 0 | 20.11822 | 43.88177 | 0 |
| | | | | | | | 0 | 2.2237 | 61.68813 | 0.088168 |
| | | | | | | | 0 | 20.11822 | 43.88177 | 0 |
| | | | | | | | 0 | 2.2237 | 61.68813 | 0.088168 |
| | | 127 | 127 | 128.14 | 123.6637 | 128 | 128 | 128 | | |
| | | w0 | w1 | w2 | w3 | w4 | w5 | w6 | | |

A : LOW COMPENSATION B : HIGH COMPENSATION

A : LOW COMPENSATION B : HIGH COMPENSATION

A : LOW COMPENSATION B : HIGH COMPENSATION

A : LOW COMPENSATION B : HIGH COMPENSATION

METHOD AND APPARATUS OF PROCESSING VIDEO SIGNAL IN PLASMA DISPLAY PANEL

BACKGROUND OF THE INVENTION

1. Field of the Invention

This invention relates to a technique of processing a video signal in a plasma display panel, and more particularly to a method and apparatus for processing a video signal in a plasma display panel that is capable of eliminating pseudo contour noise without any loss of gray scale level.

2. Description of the Related Art

Recently, a plasma display panel (PDP) has been highlighted as a display device having thin thickness and light weight. The PDP displays a picture by changing a light-emission frequency in proportion to a video signal such as a television signal, etc. More specifically, such a video signal is digitized, and this digitized video data is divided into sub-field periods in accordance with the number of bits. In each sub-field period, a light-emission having a frequency proportional to a weighting value of the digital video data is conducted to provide a gray scale display.

For instance, when it is intended to display a picture of 256 gray levels using 8-bit video data, one frame display period equal to 1/60 second (i.e. 16.67 msec) is divided into 8 sub-field periods SF1 to SF8 as shown in FIG. 1. Each sub-field period SF1 to SF8 again is divided into a reset period RP, an address period AP and a sustain period SP. Herein, the reset period RP and the address period AP are equally assigned for each sub-field period. The sustain period SP is increased at a ratio of $2^n$ (wherein n=0, 1, 2, 3, 4, 5, 6 and 7) at each sub-field.

The PDP driven with such a sub-field system superposes a light emitted in each sub-field period to display a picture corresponding to a gray level value. However, a picture display is made by superposing a light generated in the sub-field period, pseudo contour noise is generated due to inconsistency between an integration direction of light and a visual characteristic sensed by a human eye. Herein, the pseudo contour noise is generally observed a white band shape or a black band shape in which gray levels having a large difference in an light-emitting pattern, such as 127-128, 63-64 or 31-32, etc., are successively displayed.

When a light-emitting pattern is changed into 128-127, a brightness difference between two frames has a value of "1". However, as shown in FIG. 1, the first to seventh sub-field SF1 to SF7 is emitted when a gray level value of 127 is displayed; while the eighth sub-field SF8 is emitted when a gray level value of 128 is displayed. In other words, if an emitting pattern is changed into 128-127, then a time difference in emitting patterns between two frames becomes large to cause a large movement of emitting point.

FIG. 2 depicts an amount of pseudo contour noise sensed by a human's retina. Furthermore, FIG. 2 represents a gray level value of a picture displayed at the retina when images of 127 and 128 are shifted, three by three, to the left. In FIG. 2, W0 to W6 represent real positions at which a picture is sensed from the retina.

Referring to FIG. 2, a light-emission corresponding to each bit makes an affect to a position sensed by the retina as well as the next position sensed by the retina. In other words, a gray level value of 127 emerging at W0 position is made by a summation of a gray level value of 127 having been emitted from the previous pixel and a gray level value of 127 emitted from the current pixel.

As mentioned above, since a light-emission generated from any one of pixels makes an affect to adjacent pixels, gray level values sensed from W3, W4 and W5 positions, which are boundary portions between 127 and 128, are dramatically reduced to 55.67, 29.33 and 114.3, respectively, when a gray level value is changed from 127 into 128. In other words, at the W3 position, a gray level value of 55.67 is displayed due to an influence caused by a portion of a gray level value of 127 having been emitted from the previous pixel. At the W4 position, gray level values of 127 and 128 are positioned at the boundary portion to display a gray level value of 28.33. At the W5 position, a gray level value of 114.3 emerges from a gray level value of 128. As a result, pseudo contour noise taking a black stripe shape is generated from a boundary portion between the 127 frame and the 128 frame.

In order to eliminate such a pseudo contour noise, there has been suggested an error diffusion method, an equalizing pulse method and a method of changing a sequence of sub-fields, etc. In these methods, the equalizing pulse method has been known as the best scheme for reducing pseudo contour noise without any increase of sub-field. The equalizing pulse method is a scheme of increasing or decreasing a data at a position where pseudo contour noise is generated, as shown in FIG. 3, to display a picture close to an initial data.

More specifically, in FIG. 2, a gray level value of 127 is displayed at the W3 position where a gray level of 55.67 has been expressed. When a gray level of 127 is expressed at the W3 position, a gray level value of 128 emerges from the W3 position. Further, a gray level value of 44 is displayed at the W4 position where a gray level value of 29.33 has been expressed. In this case, a gray level value of 128 emerges from the W4 position by a summation of a portion of a gray level value having been displayed at the W3 position and a gray level value of 44. Likewise, a gray level of 13 is displayed at the W6 position where a gray level value of 114.3 has been displayed to express a gray level value at the W6 position.

In other words, the equalizing pulse method can change a data applied to the sub-field to display a picture close to an initial data. Accordingly, the equalizing pulse method has an advantage in that it can eliminate pseudo contour noise from ten or less sub-fields.

In order to apply the equalizing pulse method to a PDP, a knowledge about an affect of a data motion made to the current pixel and the pixels adjacent to the current pixel is needed.

TABLE 1

| | W0 | W1 | W2 | W3 |
|---|---|---|---|---|
| B0 | 0.82117 | 0.17883 | | |
| B1 | 1.227616 | 0.722383 | | |
| B2 | 1.818476 | 2.181524 | | |
| B3 | 2.127241 | 5.872757 | | |
| B4 | 1.083707 | 14.91629 | | |
| B5 | | 27.22095 | 4.779047 | |
| B6 | | 38.10091 | 25.8991 | |
| B7 | | 20.11822 | 43.88177 | |
| B8 | | 2.2237 | 61.68813 | 0.088168 |
| SUM | 7.12821 | 111.5356 | 136.248 | 0.088168 |

The above Table 1 indicates weighting values making an influence to adjacent pixels by each bit emission when an image of the PDP is shifted, three pixel by three pixel, to the left and the sustain period SP is set to a ratio of 1:2:4:8:16:32:64:64:64.

In Table 1, W0 to W3 represent positions of the retina. Herein, W1 represents a gray level displayed at the current pixel in correspondence with a data. W0, W2 and W3 represent gray levels making an affect to pixels adjacent to W1.

FIG. 4 illustrates an amount of pseudo contour noise sensed by a human's retina that is calculated with the aid of the above table 1. Further, FIG. 4 indicates a gray level value of a picture displayed at the retina when images of 127 and 128 are shifted, three picture by three picture, to the left. In FIG. 4, W0 to W6 represent positions where a picture is sensed by the retina.

Referring to FIG. 4, when a picture is moved, a gray level of 119.8718 emerges from the W2 position. Further, a gray level of 53.02007 emerges from the W3 position. Accordingly, pseudo contour noise is generated from the W3 position. The equalizing pulse method adds a gray level to a portion at which a gray level is insufficient like W2 and W3, thereby displaying a desired picture. For instance, in the equalizing pulse method, an additional gray level is applied to a portion at which a gray level is insufficient as shown in FIG. 5.

Referring to FIG. 5, a gray level of 63 is added to a gray level of 127 that is positioned at the boundary portion between 127 and 128 gray levels. Further, a gray level of 15 is added to a gray level of 128 that is positioned at the boundary portion between 127 and 128 gray levels.

If a gray level is additionally applied as mentioned above, then a gray level of 128.14 emerges from the W2 position while a gray level of 123.6637 emerges from the W3 position. In other words, in the equalizing pulse method, an additional gray level is applied to a portion at which a gray level is insufficient, thereby displaying a picture in which pseudo contour noise is reduced.

However, such a conventional equalizing pulse method cannot implement an exact image according to a data. In other words, a gray level of 128 must be displayed at the W3 position, but a gray level of approximately 124 is displayed at the W3 position. In real, the conventional equalizing method can display a picture having considerably reduced pseudo contour noise, but it has a problem in that a large difference is generated between a gray level at a position to which an equalizing pulse is applied and a real gray level to be displayed.

SUMMARY OF TEE INVENTION

Accordingly, it is an object of the present invention to provide a method and apparatus for processing a video signal in a plasma display panel wherein pseudo contour noise can be eliminated without any loss of gray level.

In order to achieve these and other objects of the invention, a method of processing a video signal in a plasma display panel according to one aspect of the present invention includes the steps of forecasting pseudo contour noise of an image to be displayed on the panel; and applying an equalizing pulse having one gray level of a first gray level higher than a grey level to be supplied and a second gray level lower than a gray level to be supplied in order to reduce or eliminate said forecasted pseudo contour noise.

In the method, said step of forecasting the pseudo contour noise includes detecting a shift direction and a shift speed of a picture and a gray level value of data using data at the (n+1)th and nth fields (wherein n is an integer), thereby forecasting said pseudo contour noise with the aid of the detected shift direction and speed of the picture and the detected gray level value of data.

Herein, said equalizing pulse having the first gray level and said equalizing pulse having the second gray level are supplied such that they are alternated for the pixel unit.

Otherwise, said equalizing pulse having the first gray level and said equalizing pulse having the second gray level are supplied such that they are alternated for the horizontal line unit.

Otherwise, said equalizing pulse having the first gray level and said equalizing pulse having the second gray level are supplied such that they are alternated on the basis of a vertical synchronizing signal.

Otherwise, said equalizing pulse having the first gray level and said equalizing pulse having the second gray level are supplied such that they are alternated on the basis of at least two signals of a pixel signal, a horizontal synchronizing signal and a vertical synchronizing signal.

The method further includes the step of alternately applying said equalizing pulses having the first and second gray levels to express a gray level value close to a gray level value to be displayed on an average basis.

A video signal processing apparatus for a plasma display panel according to another aspect of the present invention includes a reverse gamma corrector for making a reverse gamma correction of a gamma-corrected data inputted from the exterior; field delay means for delaying the reverse gamma-corrected data by one field; an equalizing pulse supplier for receiving a data at the (n+1)th field (wherein n is an integer) from the reverse gamma corrector and a data at the nth field from the field delay means, thereby eliminating pseudo contour noise; and a display data processor for receiving the nth field data and the equalizing pulse to convert them in such a manner to be suitable for a resolution format of the panel.

In the video signal processing apparatus, said equalizing pulse supplier includes an operation detector for receiving the (n+1)th and nth field data to detect a shift direction and a shift speed of a picture and a gray level of the nth field data; a pseudo contour amount forecaster for forecasting an amount of the pseudo contour noise to be generated from the panel using said shift direction and said shift speed of the picture and said gray level value of the nth field data; and a compensator for receiving said amount of the pseudo contour noise to calculate an equalizing pulse to be compensated and supply a higher compensated equalizing pulse or a lower compensated equalizing pulse than the calculated equalizing pulse.

Herein, said compensator includes an equalizing pulse calculator for receiving said amount of the pseudo contour noise to calculate said equalizing pulse to be compensated; a low compensator for supplying an equalizing pulse having a gray level value one level lower than the calculated equalizing pulse from the equalizing pulse calculator; a high compensator for supplying an equalizing pulse having a gray level value one level higher than the calculated equalizing pulse from the equalizing pulse calculator; and a multiplexor for receiving the low-compensated equalizing pulse and the high-compensated equalizing pulse to output any one of said pulses in correspondence with a control signal.

At least one of a pixel signal, a horizontal synchronizing signal and a vertical synchronizing signal is used for said control signal.

BRIEF DESCRIPTION OF THE DRAWINGS

These and other objects of the invention will be apparent from the following detailed description of the embodiments of the present invention with reference to the accompanying drawings, in which:

FIG. 4 illustrates a real gray level value displayed at each pixel when a desired gray level has been displayed for a picture;

FIG. 5 illustrates a gray level value displayed at each pixel by adding an equalizing pulse in order to reduce pseudo contour noise in FIG. 4;

DETAILED DESCRIPTION OF THE PREFERRED EMBODIMENT

Figure 1:
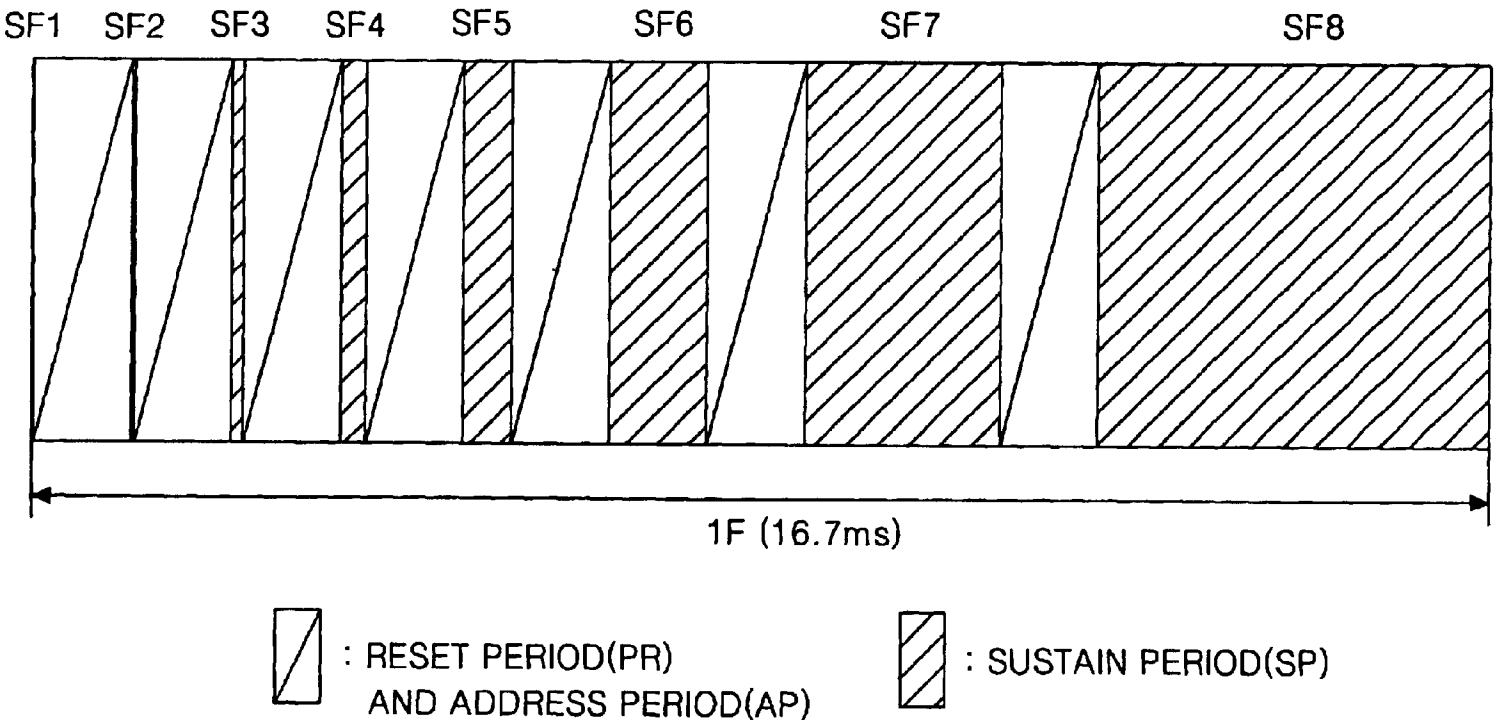
FIG. 1 RELATED ART
FIG. 1 depicts a frame driving shape according to a conventional PDP driving method.
Figure 2:
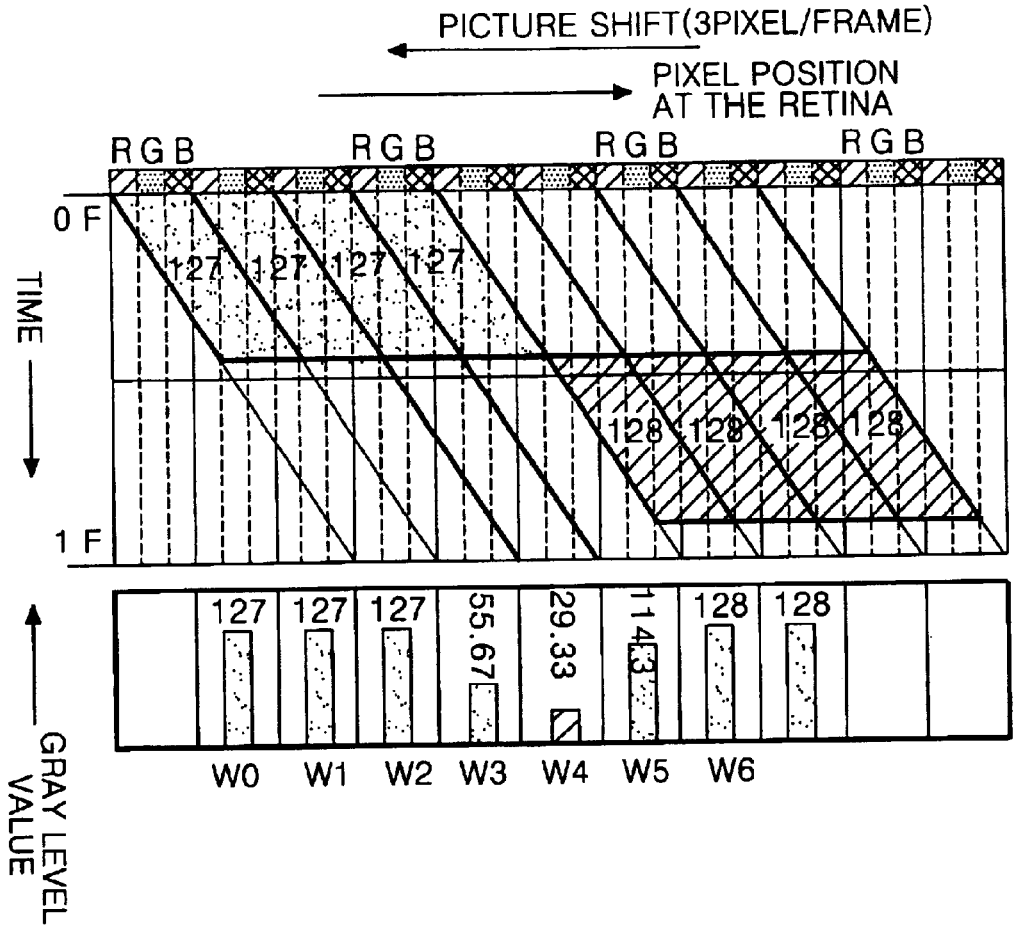
FIG.2 RELATED ART
FIG. 2 is a view for explaining a principle in which pseudo contour noise is generated in the conventional PDP driving method.
Figure 3:
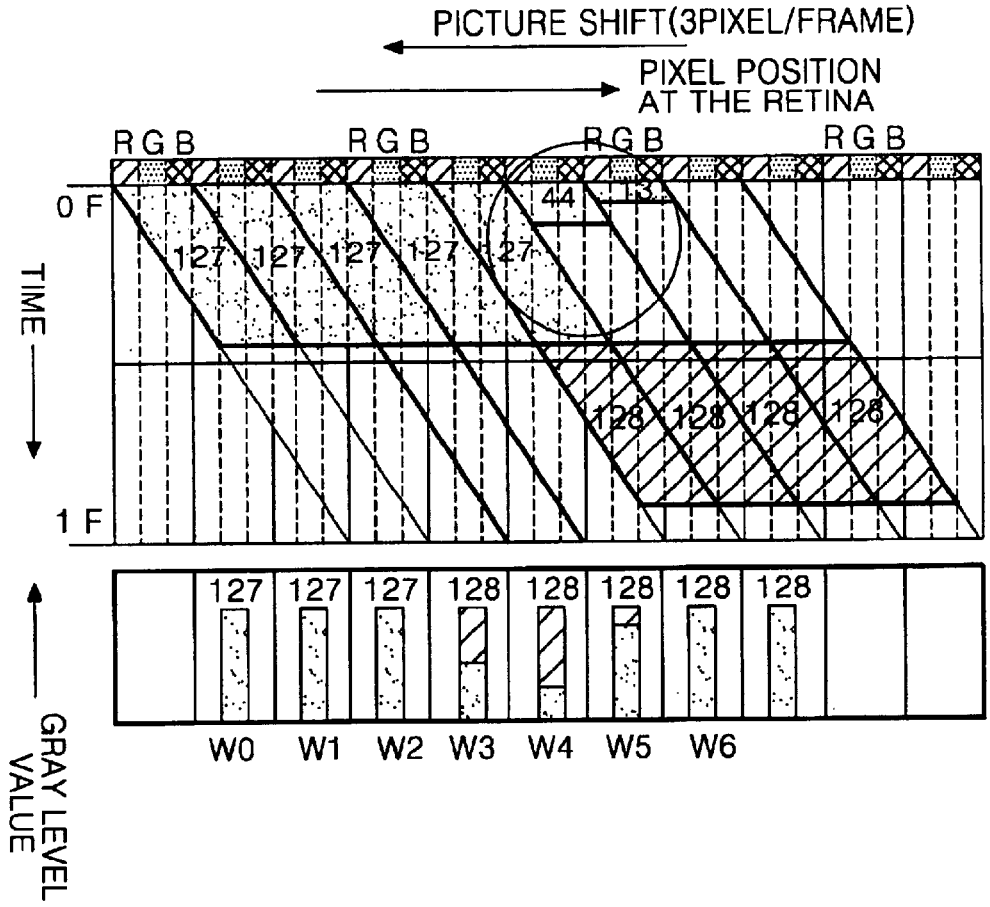
FIG.3 RELATED ART
FIG. 3 is a view for explaining a conventional equalizing pulse method.
Figure 6A:
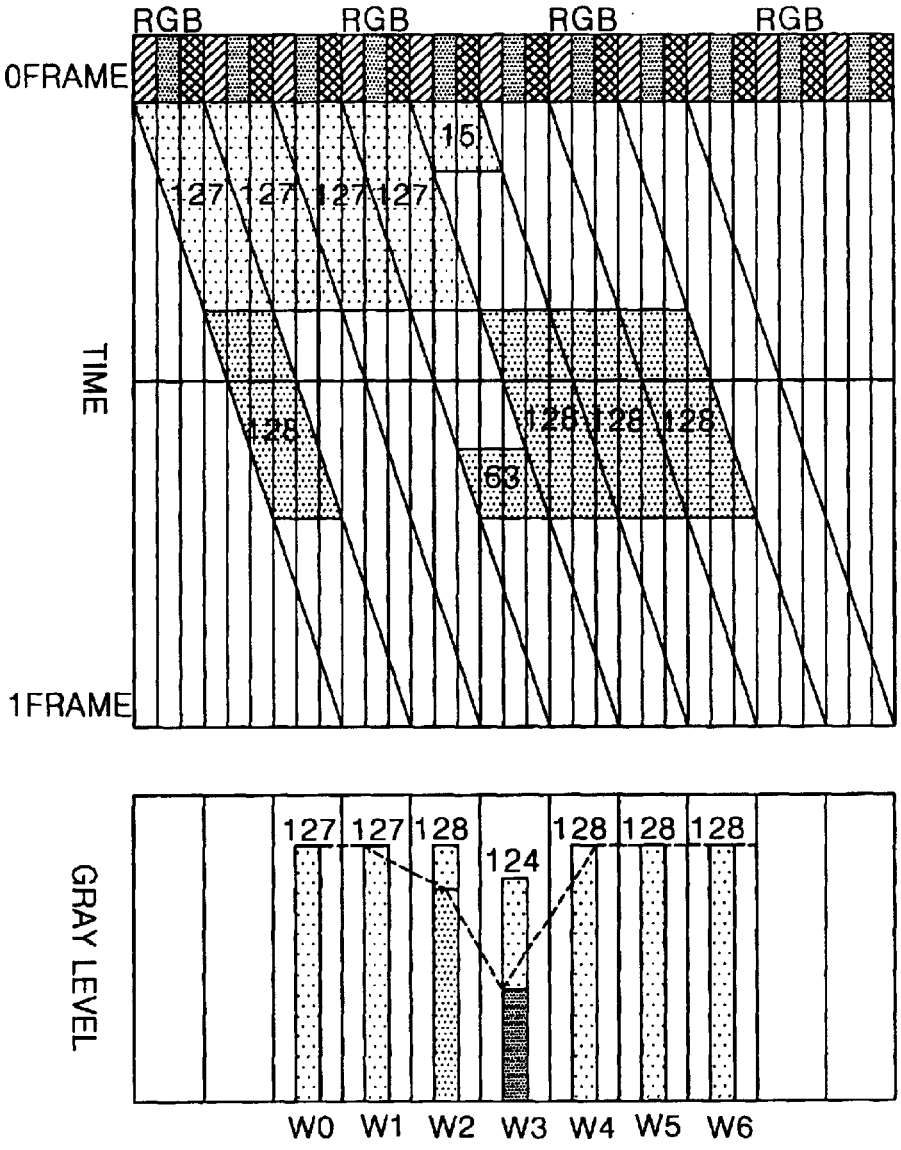
FIG. 6A to FIG. 6C depict a method of processing a video signal in a plasma display panel according to an embodiment of the present invention.
Figure 6B:
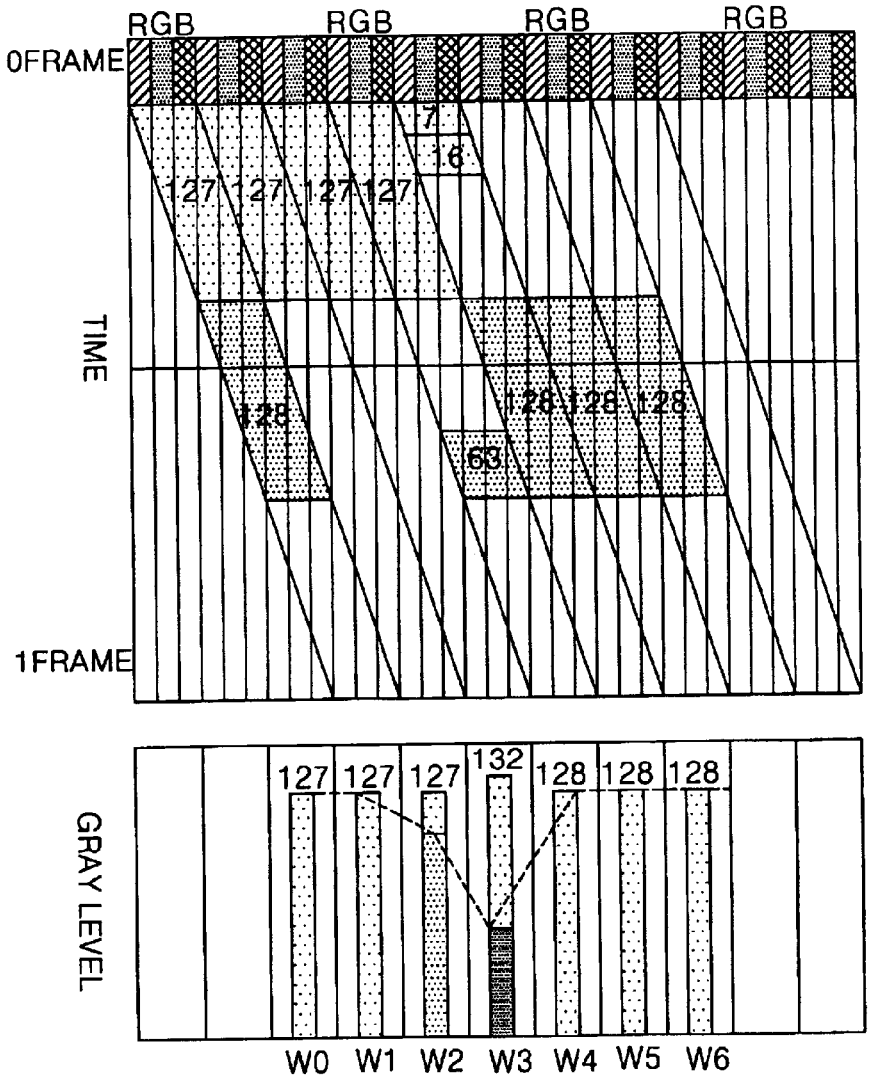
Figure 6C:
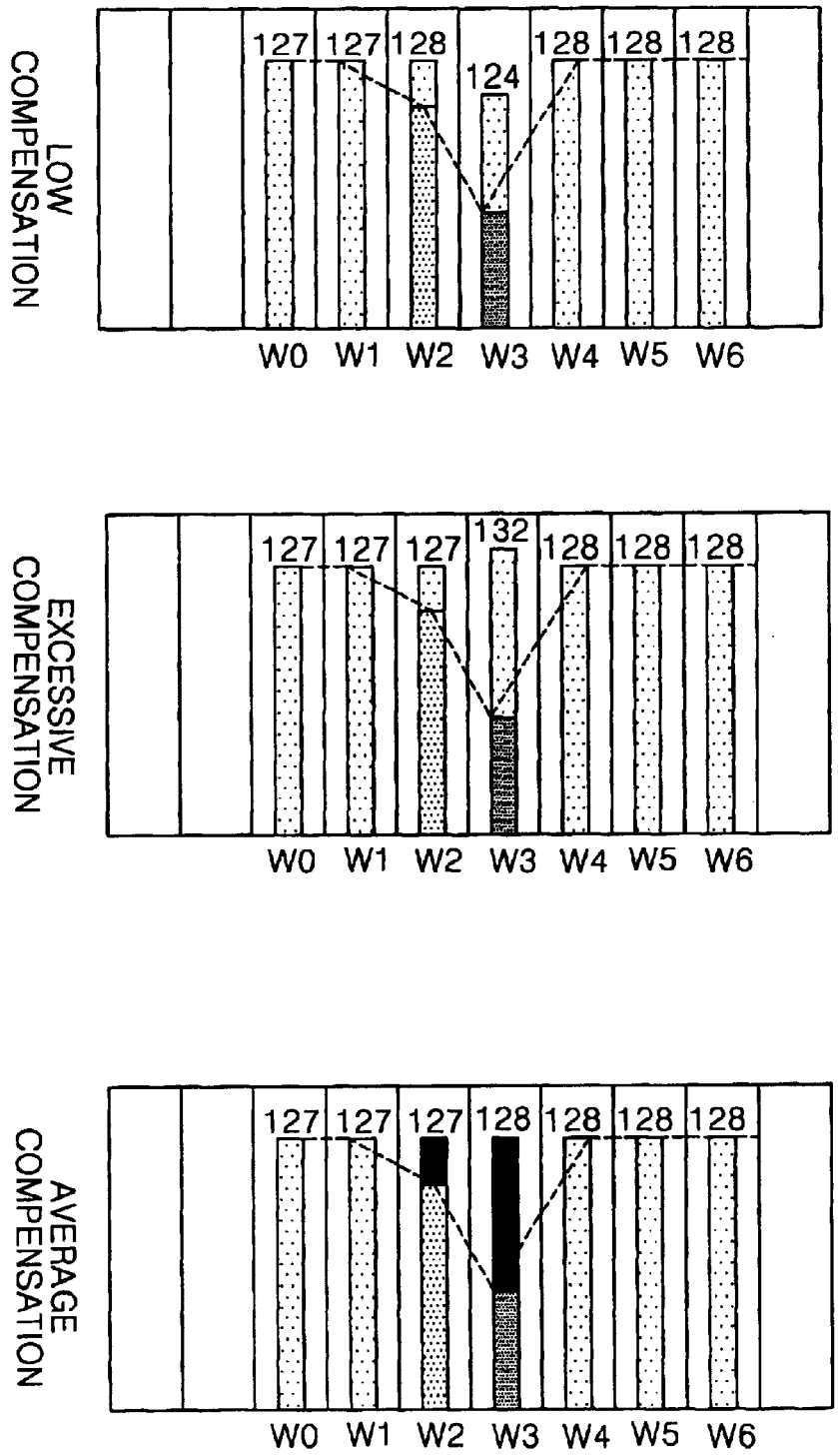

FIG. 6A to FIG. 6C show a method of processing a video signal in a plasma display panel according to an embodiment of the present invention.

Referring to FIG. 6A to FIG. 6C, a low compensation and a high compensation for a gray level is made with the aid of an equalizing pulse to revive an image having no pseudo contour noise without any loss of gray level on an average basis. More specifically, firstly, as shown in FIG. 6A, a gray level of 63 is added to a gray level value of 127 that is positioned at the boundary portion between 127 and 128 gray levels. Further, a gray level value of 15 is added to a gray level value of 128 that is positioned at the boundary portion between 127 and 128 gray levels. If a gray level value is added in this manner, then a gray level value of 124 emerges from the W3 position. Such a strategy is referred to as "equalizing pulse low compensation".

Thereafter, as shown in FIG. 6B, a gray level value of 63 is added to a gray level value of 127 that is positioned at the boundary portion between 127 and 128 gray levels. Further, a gray level value of 23 is added to a gray level value of 128 that is positioned at the boundary portion between 127 and 128 gray levels. If a gray level value is added in this manner, then a gray level value of 132 emerges from the W3 position. Such a strategy is referred to as "equalizing pulse excessive compensation".

In other words, in the method of processing a video signal in the plasma display panel according to the embodiment of the present invention, an excessive compensation and a low compensation of the equalizing pulse is repeated at a certain pixel. If an excessive compensation and a low compensation of the equalizing pulse is repeated, then it becomes possible to display a picture having a desired average gray level (i.e., a gray level of 128) as shown in FIG. 6C.

Figure 7:
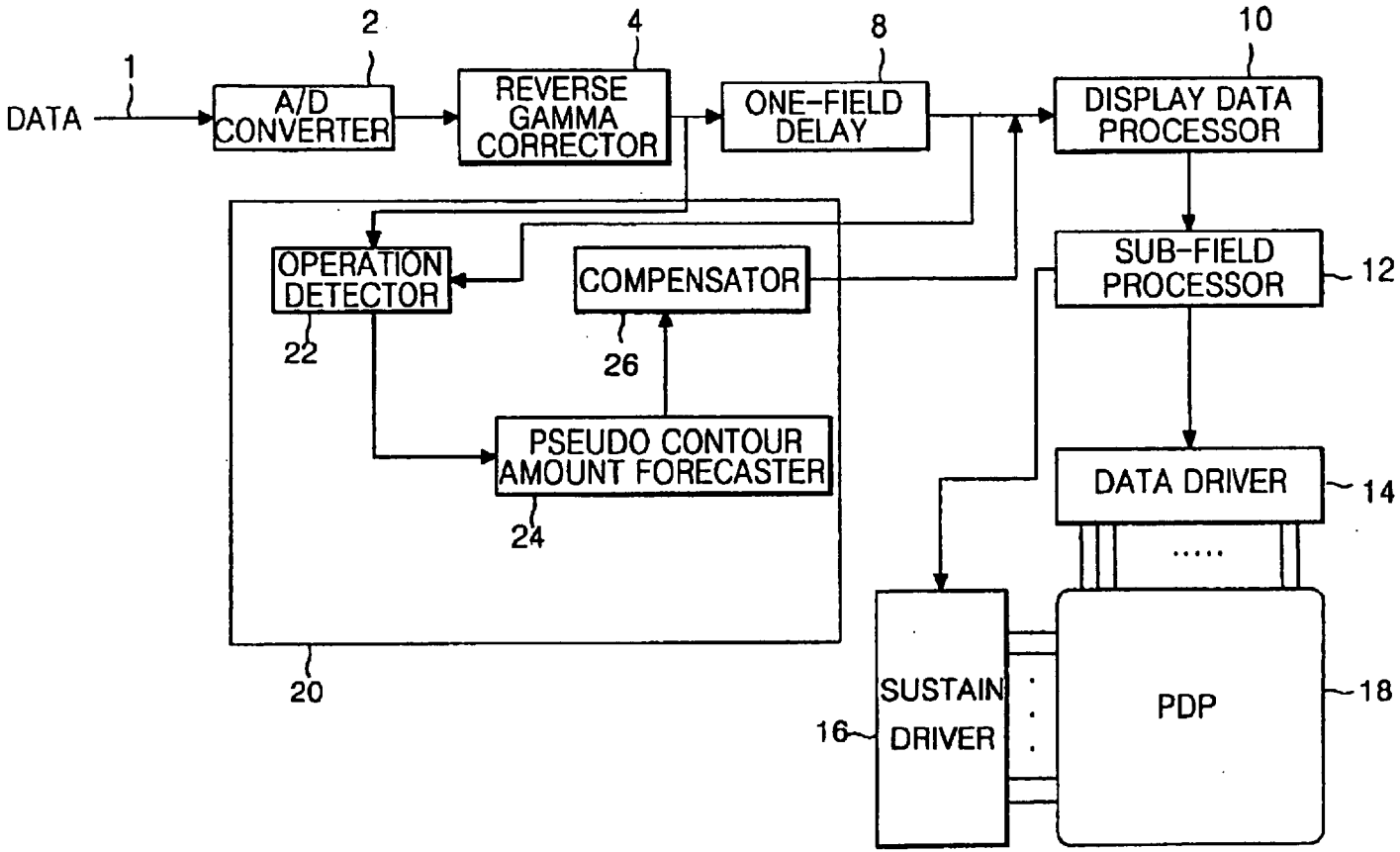
FIG. 7 is a block diagram showing a configuration of a video signal processing apparatus for a plasma display panel according to an embodiment of the present invention.
Figure 8:
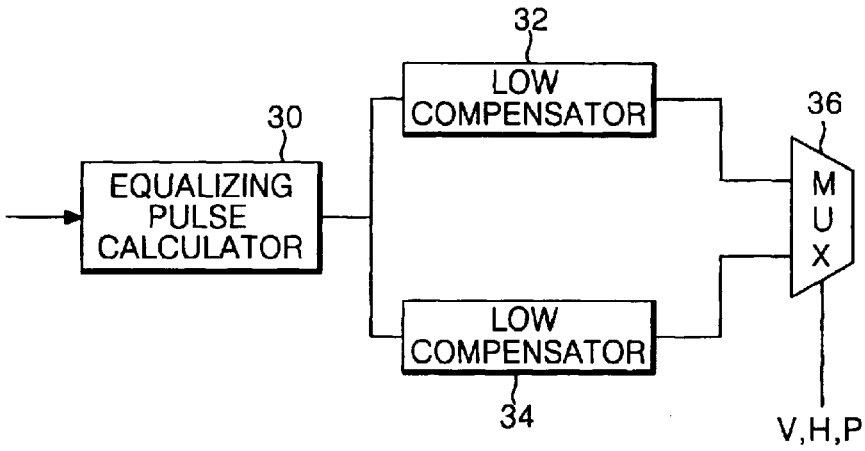
FIG. 8 is a detailed block diagram of the compensator shown in FIG. 7.

FIG. 7 shows an image signal processing apparatus for a plasma display panel according to an embodiment of the present invention.

Referring to FIG. 7, the image signal processing apparatus includes an analog to digital (AD) converter 2, a reverse gamma corrector 4, an one-field delay 8, a display data processor 10, a sub-field processor 12 and a data driver 14 that are connected between an input line 1 and a PDP 18, a sustain driver 16 provided between the sub-field processor 12 and the PDP 18, and an equalizing pulse supplier 20 connected to the reverse gamma corrector 4.

A data from the exterior is supplied to the input line 1. The A/D converter 2 converts a data inputted in an analog shape into a digital data. The reverse gamma corrector 4 makes a reverse gamma correction of a gamma-corrected data signal to linearly change a brightness value according to a gray level value of an image signal.

The equalizing pulse supplier 20 applies an excessive-compensated or low-compensated equalizing pulse to the display data processor 10. A detailed operation procedure as to the equalizing pulse supplier 20 will be described later.

The one-field delay 8 delays a data inputted thereto by one field and outputs the delayed data. The display data processor 10 converts a data signal and an equalizing pulse (i.e., a gray level value) from the equalizing pulse supplier 20 such that they are suitable for a resolution format of the PDP 18.

The sub-field processor 12 re-assigns the data signal and the equalizing pulse changed in such a manner to be suitable for the resolution format for each sub-field. Further, the sub-field processor 12 generates a desired timing control signal and applies the generated control signal to the data driver 14 and the sustain driver 16.

The data driver 14 supplies a data to the PDP with the aid of the timing control signal inputted from the sub-field processor 12. The sustain driver 16 applies a scanning pulse, a sustaining pulse and an erasing pulse, etc. to the PDP 18 with the aid of the timing control signal inputted from the sub-field processor 12. The equalizing pulse supplier 20 applies the excessive-compensated or low-compensated equalizing pulse to the display data processor 10. To this end, the equalizing pulse supplier 20 is comprised of an operation detector 22, a pseudo contour amount forecaster 24 and a compensator 26.

The operation detector 22 receives a data signal corresponding to the (n+1)th field (wherein n is an integer) from the reverse gamma corrector 4, and receives a data signal corresponding to the nth field from the one-field delay 8 at the same time. Thereafter, the operation detector 22 compares the (n+1)th data with the nth data to detect a shift direction and a shift speed of a displayed picture and a gray level value of data, etc. The pseudo contour amount forecaster 24 receives a shift direction and a shift speed of a picture and a gray level value of data from the operation detector 22 to forecast an amount of pseudo contour that may be generated from the PDP 18.

The compensator 26 calculates a gray level of an equalizing pulse to be compensated in correspondence with the amount of pseudo contour inputted from the pseudo contour forecaster 24 to apply it to the display data processor 10. In this case, the compensator 26 applies the number of the high-compensated equalizing pulse or the number of the low-compensated equalizing pulse to the display data processor 10. To this end, the compensator 26 is comprised of an equalizing pulse calculator 30, a low compensator 32, a high compensator 34 and a multiplexor (MUX) 36.

The equalizing pulse calculator 30 calculates an equalizing pulse (i.e., a gray level value) capable of compensating an amount of pseudo contour applied from the pseudo contour amount forecaster 24. The low compensator 32 supplies an equalizing pulse having a gray level value one level lower than the equalizing pulse forecasted by the equalizing pulse calculator 30. The high compensator 34 supplies an equalizing pulse having a gray level value one level higher than the equalizing pulse forecasted by the equalizing pulse calculator 30.

The MUX 36 applies any one of output signals from the low compensator 32 and the high compensator 34 to the display data processor 10 under control of at least one of a horizontal synchronizing signal H, a vertical synchronizing signal V and a pixel clock signal (or a dot clock signal) P.

Figure 9A:
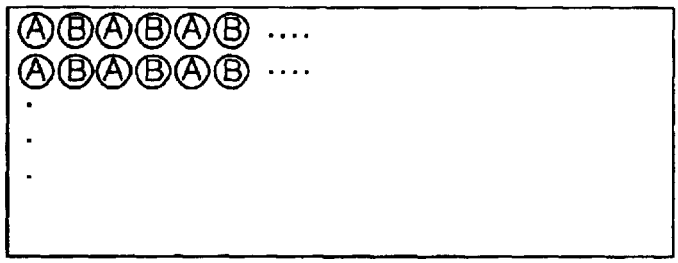
FIG. 9A shows a repetition of a high compensation and a low compensation on a basis of a pixel signal.
Figure 9B:
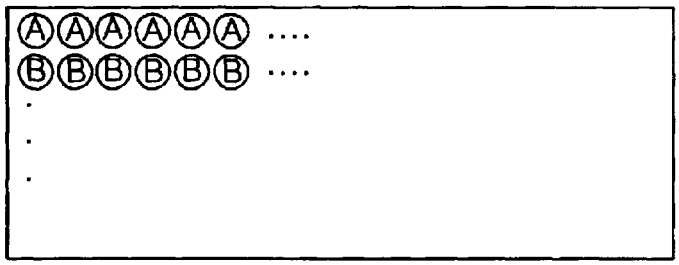
FIG. 9B shows a repetition of a high compensation and a low compensation on a basis of a horizontal synchronizing signal.

If the pixel clock signal P is inputted as a control signal of the MUX 36, then a low compensation A and a high compensation of the equalizing pulse are repeated at the PDP 18 for the pixel unit as shown in FIG. 9A. If the low compensation A and the high compensation B of the equalizing pulse are repeated for the pixel unit, then a picture in which pseudo contour noise is eliminated on an average basis is displayed on the PDP 18. Further, if the horizontal synchronizing signal H is inputted as a control signal of the MUX 36, then a low compensation A and a high compensation B of the equalizing pulse are repeated at the PDP 18 for the line unit as shown in FIG. 9B. If the low compensation A and the high compensation B of the equalizing pulse are repeated for the line unit, then a picture in which pseudo contour noise is eliminated on an average basis is displayed on the PDP 18.

Figure 9C:
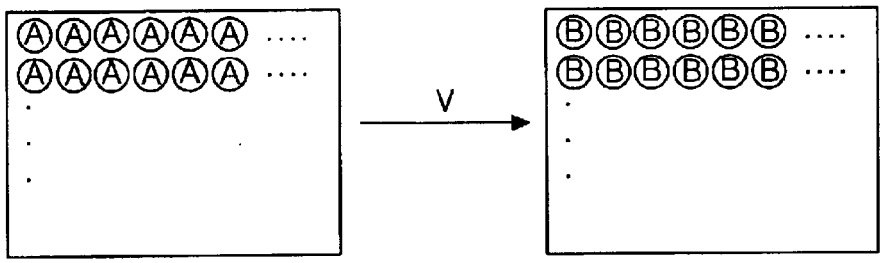
FIG. 9C shows a repetition of a high compensation and a low compensation on a basis of a vertical synchronizing signal.

If the vertical synchronizing signal V is inputted as a control signal of the MUX 36, then a low compensation A and a high compensation of the equalizing pulse are repeated at the PDP 18 on the basis of the vertical synchronizing signal as shown in FIG. 9C. If the low compensation A and the high compensation B of the equalizing pulse are repeated on the basis of the vertical synchronizing signal, then a picture in which pseudo contour noise is eliminated on an average basis is displayed on the PDP 18.

Figure 10:
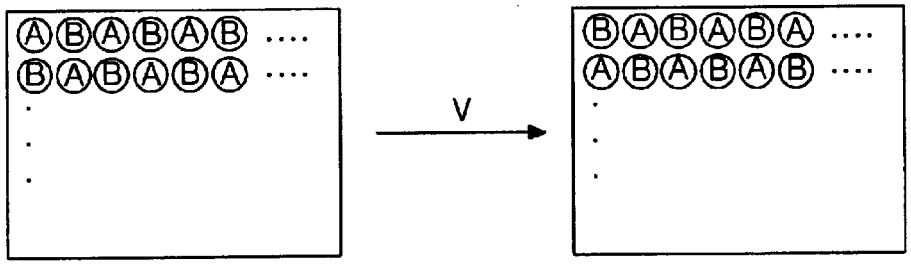
FIG. 10 shows a repetition of a high compensation and a low compensation on a basis of a pixel signal, a horizontal synchronizing signal and a vertical synchronizing signal.

Meanwhile, if the pixel clock signal P, the horizontal synchronizing signal H and the vertical synchronizing signal V are inputted as a control signal of the MUX 36, then a low compensation A and a high compensation of the equalizing pulse are repeated at the PDP 18 for the pixel unit and for the line unit as shown in FIG. 10. Furthermore, a low compensation A and a high compensation of the equalizing pulse are repeated at the PDP 18 on the basis of the vertical synchronizing signal. Accordingly, a picture in which pseudo contour noise is eliminated is displayed on the PDP 18 without any loss of gray level.

As described above, according to the present invention, the high compensation and the low compensation of the equalizing pulse are repeated for the pixel unit, for the line unit and/or for the frame unit, thereby eliminating pseudo contour noise without any loss of gray level on an average basis.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of processing a video signal in a plasma display panel, comprising:

forecasting pseudo contour noise of an image to be displayed on the panel; and applying an equalizing pulse having one gray level of a first gray level higher than a gray level to be supplied and a second gray level lower than the grey level to be supplied in order to reduce said forecasted pseudo contour noise, wherein said step of forecasting the pseudo contour noise comprises detecting a shift direction and a shift speed of a picture and a gray level value of data using data at the (n+1)th and nth fields (wherein n is an integer), thereby forecasting said pseudo contour noise with the aid of the detected shift direction and speed of the picture and the detected gray level value of data.

2. The method as claimed in claim 1, wherein said equalizing pulse having the first gray level and said equalizing pulse having the second gray level are supplied such that they are alternated for each pixel unit of a plurality of pixels of the panel.

3. The method as claimed in claim 1, wherein said equalizing pulse having the first gray level and said equalizing pulse having the second gray level are supplied such that they are alternated for a horizontal line unit of the panel.

4. The method as claimed in claim 1, wherein said equalizing pulse having the first gray level and said equalizing pulse having the second gray level are supplied such that they are alternated on a basis of a vertical synchronizing signal.

5. The method as claimed in claim 1, wherein said equalizing pulse having the first gray level and said equalizing pulse having the second gray level are supplied such that they are alternated on a basis of at least two signals of a pixel signal, a horizontal synchronizing signal and a vertical synchronizing signal.

6. The method as claimed in claim 1, further comprising:

alternately applying equalizing pulses having the first and second gray levels to express a gray level value close to a gray level value to be displayed on an average basis.

7. A video signal processing apparatus for a plasma display panel, comprising:

a reverse gamma corrector for making a reverse gamma correction of a gamma-corrected data;

field delay means for delaying the reverse gamma-corrected data by one field;

an equalizing pulse supplier for receiving a data at the (n+1)th field (wherein n is an integer) from the reverse gamma corrector and a data at the nth field from the field delay means, thereby eliminating pseudo contour noise; and a display data processor for receiving the nth field data and an equalizing pulse to convert them in such a manner to be suitable for a resolution format of the panel, wherein said equalizing pulse supplier comprises, an operation detector for receiving the (n+1)th and nth field data to detect a shift direction and a shift speed of a picture and a gray level of the nth field data, a pseudo contour amount forecaster for forecasting an amount of the pseudo contour noise to be generated from the panel using said shift direction and said shift speed of a picture and said gray level value of the nth field data, and a compensator for receiving said amount of the pseudo contour noise to calculate an equalizing pulse to be compensated and supply a higher compensated equalizing pulse or a lower compensated equalizing pulse than the calculated equalizing pulse.

8. The video signal processing apparatus as claimed in claim 7, wherein said compensator includes:

an equalizing pulse calculator for receiving said amount of the pseudo contour noise to calculate said equalizing pulse to be compensated;

a low compensator for supplying an equalizing pulse having a gray level value one level lower than the calculated equalizing pulse from the equalizing pulse calculator;

a high compensator for supplying an equalizing pulse having a gray level value one level higher than the calculated equalizing pulse from the equalizing pulse calculator; and a multiplexor for receiving the low-compensated equalizing pulse and the high-compensated equalizing pulse to output any one of said pulses in correspondence with a control signal.

9. The video signal processing apparatus as claimed in claim 8, wherein at least one of a pixel signal a horizontal synchronizing signal and a vertical synchronizing signal is used for said control signal.

10. A method of processing a video signal in a plasma display panel, comprising:

forecasting pseudo contour noise of an image to be displayed on the panel; and selectively applying equalizing pulses each having a gray level of a first gray level higher than a gray level to be supplied or a second gray level lower than the gray level to be supplied in order to reduce said forecasted pseudo contour noise, wherein said equalizing pulses having the first gray level and the second gray level are supplied such that they are alternated on a basis of at least two signals of a pixel signal, a horizontal synchronizing signal and a vertical synchronizing signal.

* * * * *